US006309813B1

(12) United States Patent
Younathan et al.

(10) Patent No.: US 6,309,813 B1
(45) Date of Patent: Oct. 30, 2001

(54) REDUCED FOG IN PHOTOGRAPHIC COATINGS CONTAINING A MONOSUBSTITUTED QUINONE

(75) Inventors: Janet N. Younathan, Fairport; Daniel L. Kapp, Rochester; Stephen P. Singer, Spencerport; David R. Foster, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/738,730

(22) Filed: Dec. 15, 2000

(51) Int. Cl.[7] ..... G03C 1/08; G03C 7/26; G03C 7/32

(52) U.S. Cl. ..... 430/551; 430/551; 430/558; 430/359

(58) Field of Search ..... 430/551, 555, 430/359, 558

(56) References Cited

U.S. PATENT DOCUMENTS

| | | | | |
|---|---|---|---|---|
| 4,277,558 | | 7/1981 | Kikuchi et al. . | |
| 4,945,031 | | 7/1990 | Sakai et al. . | |
| 5,082,764 | | 1/1992 | Takahashi . | |
| 5,104,774 | | 4/1992 | Ohki et al. . | |
| 5,200,304 | * | 4/1993 | Yoneyama et al. | 430/551 |
| 5,264,332 | | 11/1993 | Otani et al. . | |
| 5,466,568 | | 11/1995 | Kapp et al. . | |
| 5,482,821 | * | 1/1996 | Kapp et al. | 430/555 |
| 5,492,799 | * | 2/1996 | Kapp et al. | 430/359 |
| 5,591,569 | * | 1/1997 | Kapp et al. | 430/551 |
| 5,622,818 | * | 4/1997 | Kapp et al. | 430/555 |
| 5,641,613 | | 6/1997 | Boff et al. . | |

* cited by examiner

*Primary Examiner*—Geraldine Letscher
(74) *Attorney, Agent, or Firm*—Arthur E. Kluegel

(57) ABSTRACT

Disclosed is a photographic element comprising a light-sensitive silver halide emulsion layer containing an azopyrazolone masking coupler and a monosubstituted quinone of formula I:

I wherein R is selected from the group consisting of alkyl, aryl, alkoxy, aryloxy, alkylthio, arylthio, sulfinyl, sulfonyl, sulfamoyl, halogen, cyano, thiol, hydroxy, nitro, acyloxy, sulfonyloxy, heterocyclic, carboxylic acid, carboxylate, carbamoyl, amino, carbonamido and sulfonamido groups.

20 Claims, No Drawings

REDUCED FOG IN PHOTOGRAPHIC COATINGS CONTAINING A MONOSUBSTITUTED QUINONE

FIELD OF THE INVENTION

This invention relates to a silver halide photographic element that comprises a light-sensitive silver halide emulsion layer containing an azopyrazolone masking coupler and a monosubstituted quinone.

BACKGROUND OF THE INVENTION

In order to manufacture a material for producing color photographic images, at least three layers are coated onto an inert support, each layer containing a light-sensitive silver halide emulsion and a photographic coupler capable of forming yellow, magenta, or cyan dye when reacted with oxidized color developing agent. The photographic coupler and the light-sensitive silver halide emulsion are suspended in gelatin, resulting in a mixture that is uniform, but solid and un-coatable at room temperature. Prior to coating, this mixture must be melted at 45° C. so that it flows smoothly through the manufacturing delivery lines and onto the inert support.

In the course of a large-scale manufacturing in, the gelatinous emulsion-coupler mixture is often held at 45° C. for up to 16 hours. Unfortunately, this prolonged heating, which is necessary for smooth flow of the mixture, can also cause inferior performance in the resulting photographic product, such as increased fog, reduced contrast, and speed loss. To overcome this deficiency, it is common practice to separately hold the melted light-sensitive silver halide emulsion from the melted photographic couplers and mix them only immediately prior to coating.

Although separating the melted silver halide emulsion from the melted photographic couplers effectively stabilizes the mixture and prevents increased fog, reduced contrast, and speed loss in the resulting product, it is preferable that both the silver halide emulsion and the couplers reside in a single reservoir for case of manufacturing. In the manufacture of a film product, having fewer mixtures simplifies handling and requires fewer delivery lines. Unused delivery lines can in turn be dedicated to additional layers for the purpose of augmenting photographic performance. It is therefore desirable that the light-sensitive silver halide emulsion and the photographic couplers for a given color layer be thermally stable as a single mixture.

A melted coupler-emulsion mixture for any color layer can potentially exhibit thermal instability when the silver halide emulsion and the couplers are combined and heated prior to coating. However, our experience indicates that mixtures containing the silver halide emulsion with azopyrazolone magenta masking couplers are especially prone to this problem. The use of azopyrazolone masking couplers is well known in the art. See, for example, U.S. Pat. Nos. 2,428,034; 2,434,272; 2,455,170; 2,688,539; 2,704,711; 2,808329; 3,476,560; 3,796,574; 4,427,763; 4,777,123, and EP 213,490. Masking couplers have proven useful for correcting the unwanted blue absorption typical of most magenta photographic dyes. The magenta masking coupler, which is yellow in color, has a blue absorption in non-exposed areas of the film. In exposed areas, this blue absorption is destroyed as the masking coupler reacts with oxidized color developing agent and develops into a magenta dye. The loss of blue density from the masking dye is concurrently balanced by the increase in blue density from the magenta imaging dye. Thus, the combination of the magenta imaging dye and the unreacted masking dye uniformly absorbs a low level of blue light across the imaging scale, effectively canceling the unwanted blue absorption inherent in the magenta imaging dye alone.

While yellow-colored azopyrazolone masking couplers have been used as a means of correcting the unwanted blue absorption of magenta photographic dyes, it is especially difficult to manufacture an excellent product from a single melted mixture containing both the light-sensitive silver halide emulsion and the azopyrazolone masking coupler. The thermal instability of this melted mixture is inherent in the resulting photographic product, which compared to a product manufactured from separate preparations of the emulsion and the coupler, exhibits increased fog, low contrast, and speed loss, but most particularly increased fog. Several additives have previously been proposed to mitigate fog caused by azopyrazolone masking couplers, including a low impact development inhibitor releasing coupler (U.S. Pat. No. 5,641,613) and ballasted nitroaromatic compounds (U.S. Pat. No. 5,466,568). However, these inventions primarily reduce fog generated during the development step and exhibit little to no efficacy toward stabilizing the melted emulsion-coupler mixture prior to coating.

It is desirable to manufacture a photographic element whereby a gelatinous mixture containing an azopyrazolone masking coupler can be simultaneously heated with a silver halide emulsion without incurring inferior performance in the resulting photographic product. We have discovered that certain quinones stabilize against heat-induced degradation in such a way that a gelatinous mixture containing an azopyrazolone masking coupler and a silver halide emulsion can be heated and held in a single reservoir for 16 hours without significantly affecting the performance of the resulting product, and in addition, help control undesirable increase in fog of the film during long term storage prior to exposure and development.

It is known in the art to employ certain quinones and hydroquinones for the purpose of improving photographic performance. See, for example, U.S. Pat. Nos. 4,945,031, 5,082,764, 5,104,774, and 5,264,332, which employ a diffusion-resistant quinone for decreasing the processing time for cyan couplers. These inventions, however, do not suggest the advantageous effect of combining a quinone with an azopyrazolone magenta masking coupler, and in fact, disclose that either a quinone or a hydroquinone or a combination of both is effective for the purpose of the patent. It is also known in the art to employ quinones and hydroquinones for the purpose of reducing the formation of photographic fog. For example, U.S. Pat. No. 4,277,558 relies on diffusion-resistant quinones and hydroquinones for reducing fog in combination with certain yellow dye-forming couplers. The present inventors have ascertained that disubstituted quinones taught in the art do not effectively inhibit fog formed by azopyrazolone masking couplers, although they are effective in inhibiting fog from certain yellow dye-forming couplers. Practice of any of the above-mentioned inventions, therefore, does not satisfy the objectives of the present invention.

It is a problem to be solved to provide a photographic element containing an azopyrazolone masking coupler that can be heated in the presence of a silver halide emulsion without incurring significant degradation in performance of the resulting photographic product.

SUMMARY OF THE INVENTION

The invention provides a photographic element comprising a light-sensitive silver halide emulsion layer containing an azopyrazolone masking coupler and a monosubstituted quinone of formula I:

I

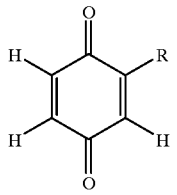

wherein R is selected from the group consisting of alkyl, aryl, alkoxy, aryloxy, alkylthio, arylthio, sulfinyl, sulfonyl, sulfamoyl, halogen, cyano, thiol, hydroxy, nitro, acyloxy, sulfonyloxy, heterocyclic, carboxylic acid, carboxylate, carbamoyl, amino, carbonamido and sulfonamido groups.

The invention also provides an improved imaging method employing the photographic element of the invention.

DETAILED DESCRIPTION OF THE INVENTION

The invention is generally as described above. The quinone useful in the inventions is represented by formula I:

I

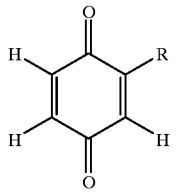

R is suitably a substituent selected from the group consisting of alkyl (including straight chain, branched, and cyclo-alkyl), aryl, alkoxy or aryloxy, alkylthio or arylthio, sulfoxyl, sulfonyl, sulfamoyl

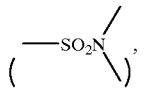

halogen such as fluoro, chloro, bromo or iodo, —O—CO—, —O—$SO_2$—, a heterocyclic group such as furanyl or morpholino, a carbonyl group such as keto, carboxylic acid (—$CO_2H$), carboxylate ester (—$CO_2$—) or carbamoyl

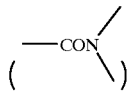

or an amino group such as a primary, secondary or tertiary substituted nitrogen, carbonamido (>NCO—) or sulfonamido (>$NSO_2$—). It should be noted wherever it is possible to write alternative tautomeric structures of the quinone nucleus, these are considered to be chemically equivalent and are part of the invention.

The advantage of this invention is that the light-sensitive emulsion and the couplers, including the azopyrazolone masking coupler, can during manufacturing, be heated at 45° C. in a single reservoir for up to 16 hours without significantly affecting the ultimate sensitometric properties of the subsequently coated photographic layer. In addition, the presence of the monosubstituted quinone helps to control undesirable increase in fog of the film during long-term storage prior to exposure and development.

It is preferred that the R substituent of the quinone be of sufficient size and confer sufficient oil solubility to the molecule in order to limit mobility and diffusion in the film element. It is desirable for R to contain a minimum of 6 carbon atoms, or more preferably, at least 8 carbon atoms or most preferably, at least 10 carbon atoms.

Compounds in which R is an alkyl (including straight chain, cyclo- or branched alkyl), aryl, amino, alkoxy or aryloxy group are preferred, and those in which R is an alkyl, aryl or amino group are especially preferred.

Examples of quinones suitable for use in this invention are as follows:

Q-1

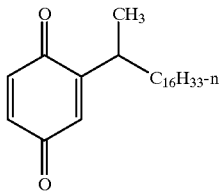

Q-2

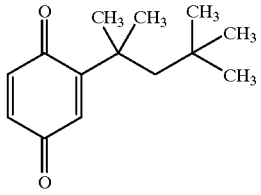

Q-3

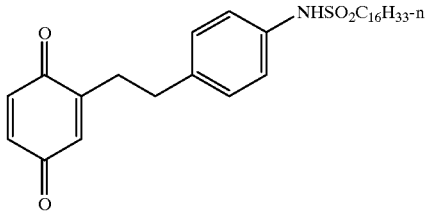

Q-4

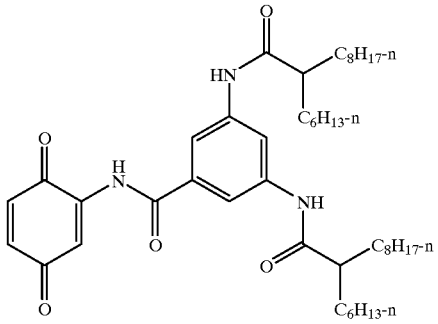

Q-5

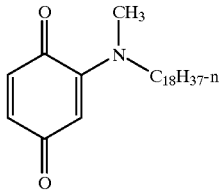

-continued
Q-6
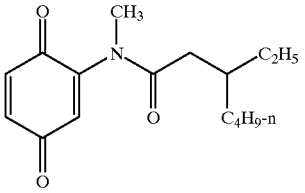
Q-7
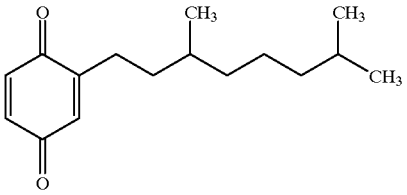
Q-8
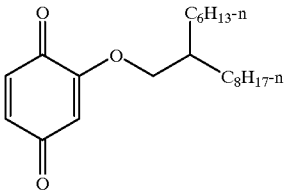
Q-9
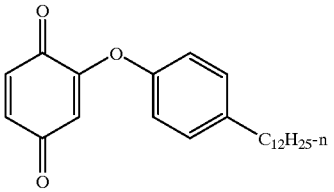
Q-10
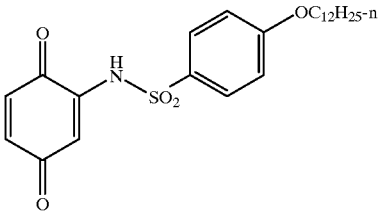
Q-11
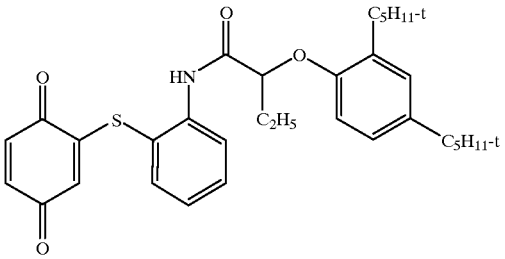
Q-12
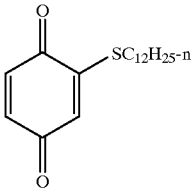
-continued
Q-13
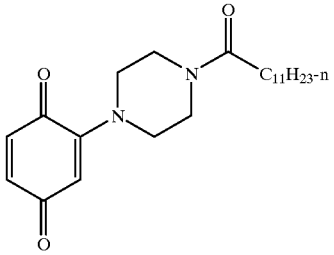
Q-14
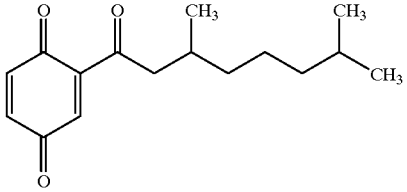
Q-15
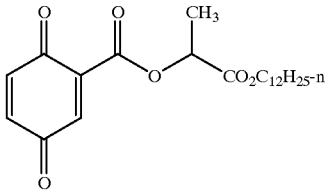
Q-16
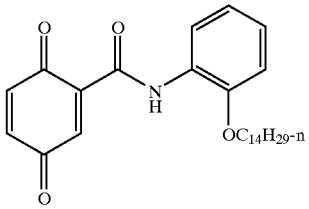
Q-17
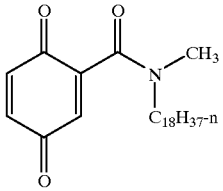
Q-18
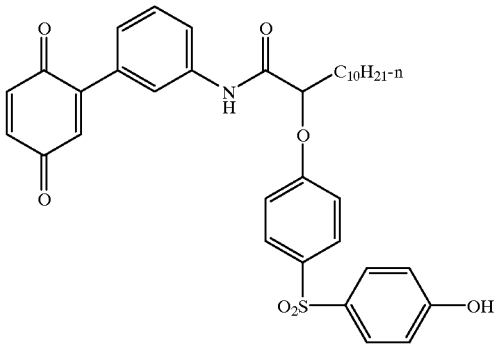

-continued

Q-19

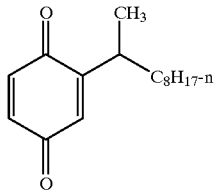

Q-20

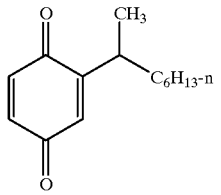

The quinones and masking couplers of the invention are added directly to the film element during manufacture and are not part of any of the developer solutions. The quinones of the invention are preferably added to a mixture containing silver halide before coating but can also be mixed with the silver halide just prior to or during coating. In either case, additional components like couplers, doctors, surfactants, hardeners and other materials that are typically present in such solutions may also be present at the same time. The quinones may be added directly if dissolved in an organic water miscible solution such as methanol, acetone or the like or more preferably added as a dispersion. A dispersion incorporates the material in a stable, finely divided state in a hydrophobic organic solvent (often referred to as a coupler solvent or permanent solvent) that is stabilized by suitable surfactants and surface active agents usually in combination with a binder or matrix such as gelatin. The dispersion may contain one or more permanent solvents that dissolve the material and maintain it in a liquid state. Some examples of suitable permanent solvents are tricresylphosphate, N,N-diethyllauramide, N,N-dibutyllauramide, p-dodecylphenol, dibutylphthalate, di-n-butyl sebacate, N-n-butylacetanilide, 9-octadecen-1-ol, ortho-methylphenyl benzoate, trioctylamine and 2-ethylhexylphosphate. Preferred classes of solvents are carbonamides, phosphates, alcohols and esters. When a solvent is present, it is preferred that the weight ratio of total compound to solvent be at least 1 to 0.5, or most preferably, at least 1 to 1. The dispersion may require an auxiliary coupler solvent initially to dissolve the component but this is removed afterwards, usually either by evaporation or by washing with additional water. Some examples of suitable auxiliary coupler solvents are ethyl acetate, cyclohexanone and 2-(2-butoxycthoxy)ethyl acetate. The dispersion may also be stabilized by addition of polymeric materials to form stable latexes. Examples of suitable polymers for this use generally contain water-solubilizing groups or have regions of high hydrophilicity. Some examples of suitable dispersing agents or surfactants are Alkanol XC or saponin. Other components of the system such as an image coupler or an oxidized developer scavenger may be additionally added so that all are present in the same oil droplet. It is also possible to incorporate the materials of the invention as a solid particle dispersion; that is, a slurry or suspension of finely ground (through mechanical means) compound. These solid particle dispersions may be additionally stabilized with surfactants and/or polymeric materials as known in the art. Also, additional permanent solvent may be added to the solid particle dispersion to help increase activity.

The quinones of the invention are preferably dispersed as an intimate admixture with the azopyrazolone masking coupler. The molar ratio of quinone to masking coupler can range from 1:100 to 100:1, more preferably range from 1:5 to 5:1 and most preferably, range from 1:2 to 2:1.

As discussed above, the azopyrazolone masking couplers of the invention are well known in the prior art. Useful azopyrazolones are, for example, discussed in U.S. Pat. Nos. 5,641,613 and 5,466,568 whose contents are incorporated in their entirely. The general structure of such materials is shown in the following formula:

CP—n=N—AR

In the formula, CP represents a 5-pyrazolone magenta coupler residual group (provided, however, that the azo group is attached to the active site of the pyrazolone at the 4 position) and AR represents an aryl or aromatic heterocyclic group.

The magenta coupler residual group represented by CP suitably has the formula:

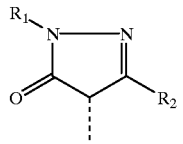

where $R_1$ represents a substituted or unsubstituted aryl or aromatic heterocyclic group, $R_2$ represents a substituted or unsubstituted acylamino group, anilino group, ureido group or carbamoyl group, the dotted line represents the azo bond. $R_1$ and $R_2$ typically contain 1 to 42 carbon atoms. Preferred groups for $R_1$ are phenyl groups which can be substituted with 1–5 halide atoms, alkoxy groups, alkyl groups, sulfamoyl, sulfonyl, carbamoyl or carboxylate esters or combinations thereof. Preferred groups for $R_2$ are substituted anilino or acylamino groups.

The aryl or aromatic heterocyclic groups represented by AR are suitable substituted with halide atoms, alkoxy groups, alkyl groups, hydroxyl groups, carbonamido groups, sulfonamido groups, etc. There may be any combination of these substituents and may be up to 5 substituents on an aryl ring or 9 for a napthyl group. Particularly preferred AR groups are phenyl groups substituted with at least one alkyl, alkyoxy, hydroxy or acylamido group or combinations thereof.

Examples of azopyrazolone masking couplers represented by the formula are shown below, but are no means limited to these.

YM-1
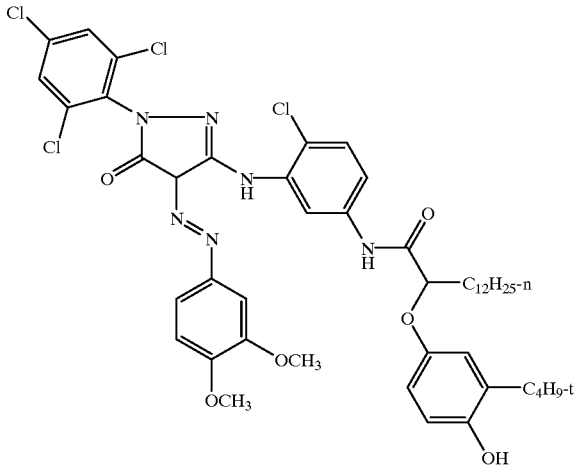
YM-2
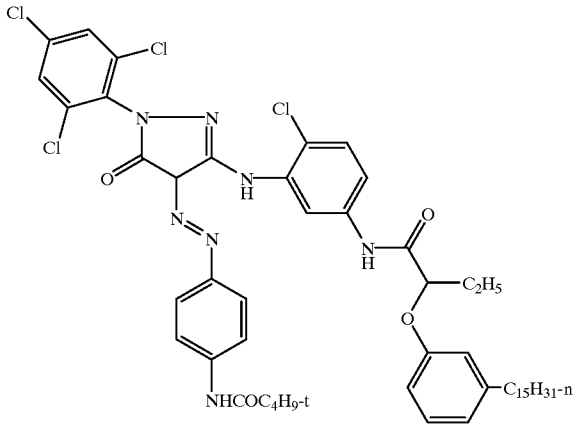
YM-3
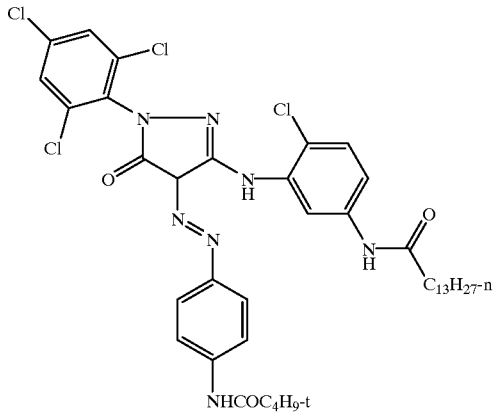
-continued
YM-4
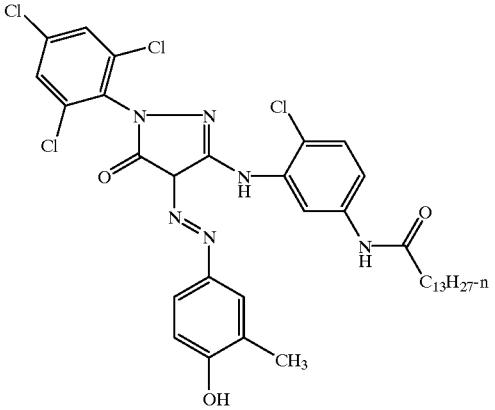
YM-5
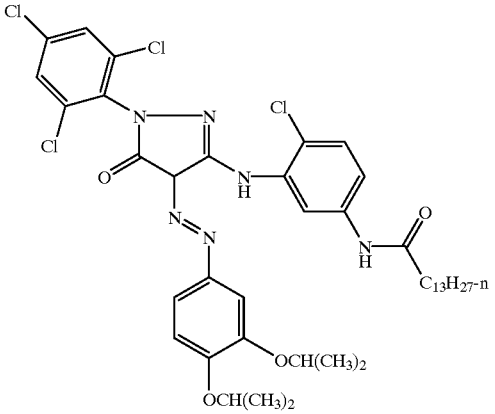
YM-6
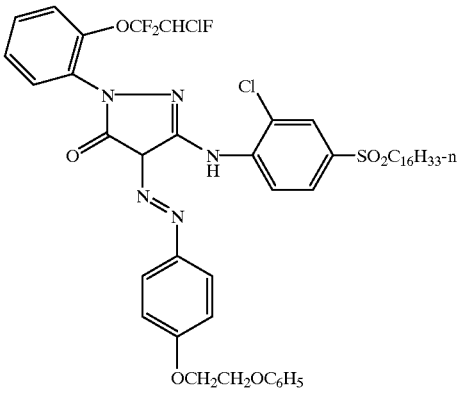

-continued

YM-7

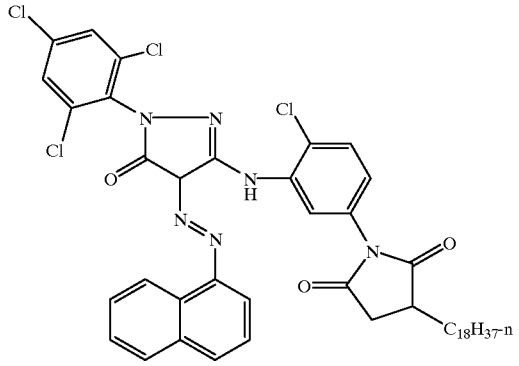

YM-8

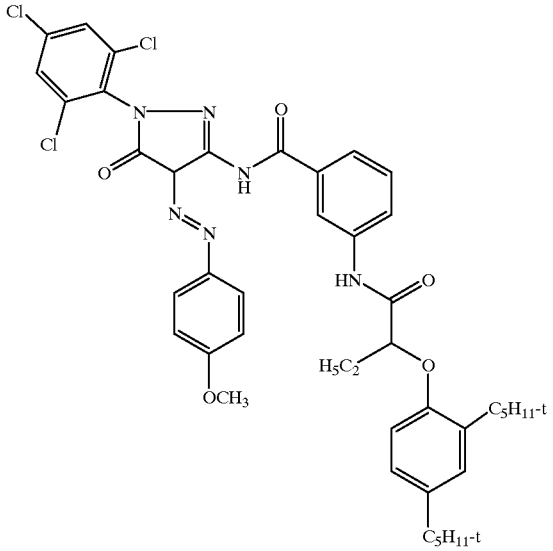

YM-9

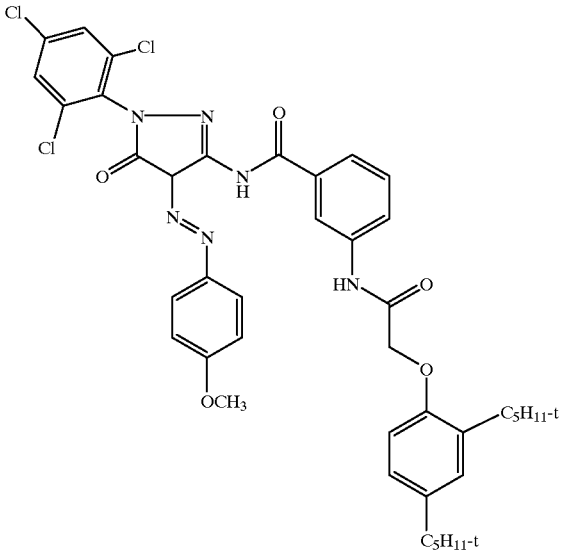

The quinones and azopyrazolone couplers of the invention may be used in conjunction with any known type of magenta image coupler or any other type of magenta dye forming coupler such as a magenta development inhibitor releasing coupler. Particularly useful magenta couplers for use in this invention are magenta pyrazolone couplers or bicyclic azole couplers such as pyrazolotriazoles. Suitable magenta pyrazolone couplers are according to the formula:

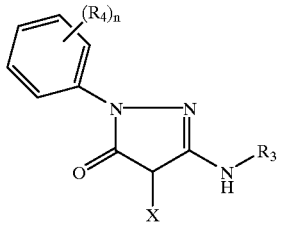

where X is a hydrogen or a coupling-off group, $R_3$ is a phenyl ring or a carbonyl, $R_4$ is a halogen atom and n=1 to 5. Suitable bicyclic azole couplers are according to either of the formulas:

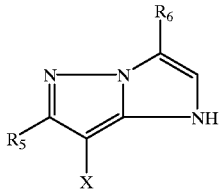

or

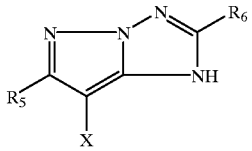

where X is a hydrogen or coupling-off group, $R_5$ and $R_6$ are independently chosen from among alkyl, aryl, alkyloxy, aryloxy or amino groups.

Examples of specific magenta image couplers represented by the formula are shown below, but are no means limited to these.

MC-1

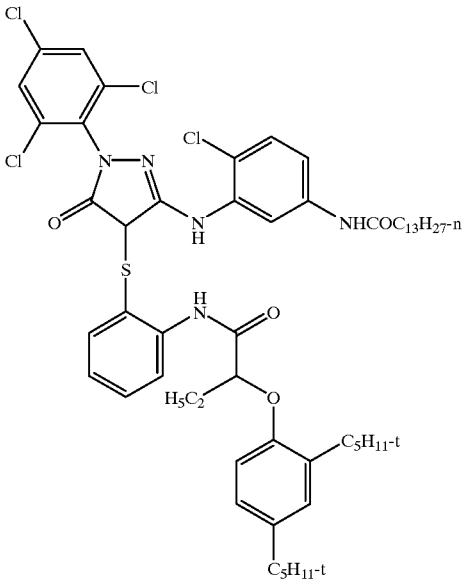

-continued
MC-2
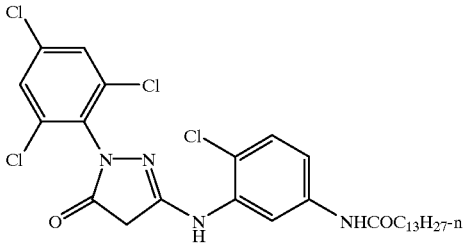
MC-3
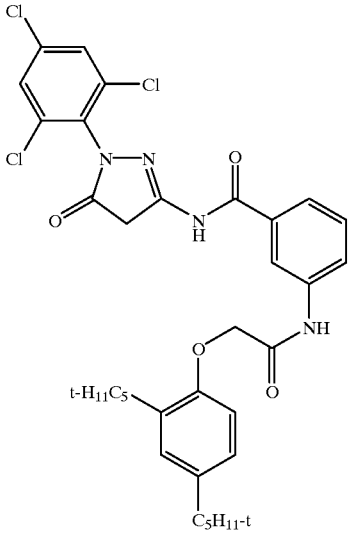
MC-4
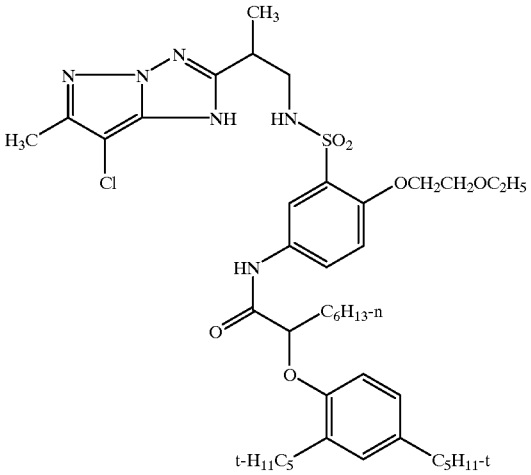
-continued
MC-5
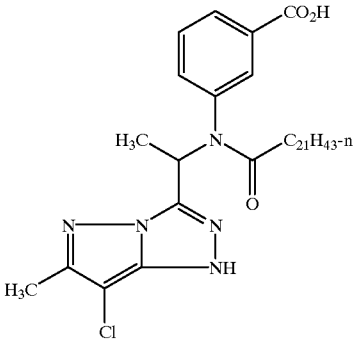
MC-6
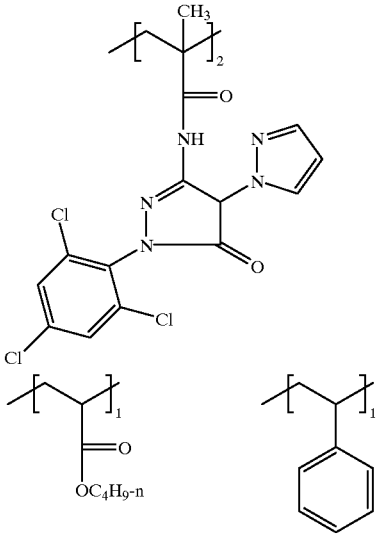
MC-7
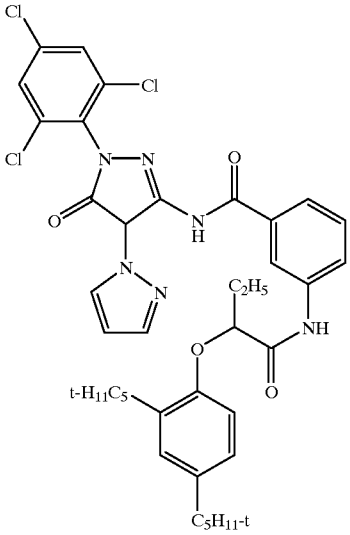

-continued

MC-8

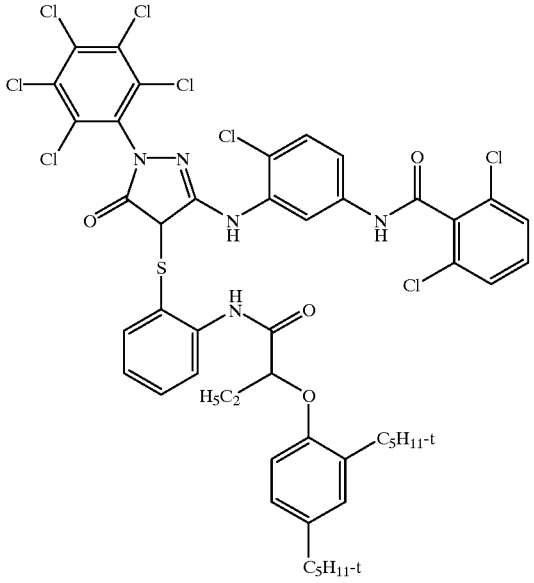

Unless otherwise specifically stated, use of the term "substituted" or "substituent" means any group or atom other than hydrogen. Additionally, when the term "group" is used, it means that when a substituent group contains a substitutable hydrogen, it is also intended to encompass not only the substituent's unsubstituted form, but also its form further substituted with any substituent group or groups as herein mentioned, so long as the substituent does not destroy properties necessary for photographic utility. Suitably, a substituent group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain or cyclic alkyl, such as methyl, tlifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy)ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentylphenoxy)acetamido, alpha-(2,4-di-t-pentylphenoxy) butyramido, alpha-(3-pentadecylphenoxy)-hexanamido, alpha-(4-hydroxy-3-t-butylphenoxy)tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazoidinyl, 3-dodecyl-2,5-dioxo-1imidazolyl, and N-acetyl-N-dodecylainino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl)carbonylamino, p-dodecylphenylcarbonylamino, p-tolylcarbonylamino, N-methylurcido, N,N-dimnethylureido, N-methyl-N-dodecylureido, N-hexadecylureido, N,N-dioctadccylureido, N,N-dioctyl-N'-ethylureido, N-phenylureido, N,N-diphenylureido, N-phenyl-N-p-tolylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-tolylsulfonamido, p-dodecylbenzenesulfonamido, N-methyltetradecylsulfonamido, N,N-dipropylsulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amnylphenoxy)acetyl, phenoxycarbonyl, p-dodecyloxyphcnoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-tolylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodccylsulfinyl, hexadecylsulfinyl, phenylsulfinyl, 4-nonylphenylsulfinyl, and p-tolylsulfinyl; thio, such as ethylthio, octylthio, benzylthio, tetradecylthio, 2-(2,4-di-t-pentylphenoxy)ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amine, such as phenylanilino, 2-chloroanilino, diethylamine, dodecylamine; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. When a molecule may have two or more substituents, the substituents may be joined together to form a ring such as a fused ring unless otherwise provided. Generally, the above groups and substituents thereof may include those having up to 48 carbon atoms, typically 1 to 36 carbon atoms and usually less than 24 carbon atoms, but greater numbers are possible depending on the particular substituents selected.

The materials of the invention can be used in any of the ways and in any of the combinations known in the art. Typically, the invention materials are incorporated in a melt and coated as a layer described herein on a support to form part of a photographic element. When the term "associated" is employed, it signifies that a reactive compound is in or adjacent to a specified layer where, during processing, it is capable of reacting with other components.

To control the migration of various components, it may be desirable to include a high molecular weight hydrophobe or "ballast" group in coupler molecules. Representative ballast groups include substituted or unsubstituted alkyl or aryl groups containing 8 to 42 carbon atoms. Representative substituents on such groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arysulfonyl, sulfonamido, and sulfamoyl groups wherein the substituents typically contain 1 to 42 carbon atoms. Such substituents can also be further substituted.

The photographic elements can be single color elements or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, and subbing layers.

If desired, the photographic element can be used in conjunction with an applied magnetic layer as described in *Research Disclosure,* November 1992, Item 34390 published by Kenneth Mason Publications, Ltd., Dudley Annex, 12a North Street, Emsworth, Hampshire PO10 7DQ, ENGLAND, and as described in Hatsumi Kyoukai Koukai Gihou No. 94-6023, published Mar. 15, 1994, available from the Japanese Patent Office, the contents of which are incorporated herein by reference. When it is desired to employ the inventive materials in a small format film, *Research Disclosure,* June 1994, Item 36230, provides suitable embodiments.

In the following discussion of suitable materials for use in the emulsions and elements of this invention, reference will be made to *Research Disclosure,* September 1996, Item 38957, available as described above, which will be identified hereafter by the term "Research Disclosure". The contents of the Research Disclosure, including the patents and publications referenced therein, are incorporated herein by reference, and the Sections hereafter referred to are Sections of the Research Disclosure.

Except as provided, the silver halide emulsion containing elements employed in this invention can be either negative-working or positive-working as indicated by the type of processing instructions (i.e. color negative, reversal, or direct positive processing) provided with the element. Suitable emulsions and their preparation as well as methods of chemical and spectral sensitization are described in Sections I through V. Various additives such as UV dyes, brighteners, antifoggants, stabilizers, light absorbing and scattering materials, and physical property modifying addenda such as hardeners, coating aids, plasticizers, lubricants and matting agents are described, for example, in Sections II and VI through VIII. Color materials are described in Sections X through XIII. Suitable methods for incorporating couplers and dyes, including dispersions in organic solvents, are described in Section X(E). Scan facilitating is described in Section XIV. Supports, exposure, development systems, and processing methods and agents are described in Sections XV to XX. Certain desirable photographic elements and processing steps are described in *Research Disclosure,* Item 37038, February 1995.

Coupling-off groups are well known in the art. Such groups can determine the chemical equivalency of a coupler, i.e., whether it is a 2-equivalent or a 4-equivalent coupler, or modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, and color correction.

The presence of hydrogen at the coupling site provides a 4-equivalent coupler, and the presence of another coupling-off group usually provides a 2-equivalent coupler. Representative classes of such coupling-off groups include, for example, chloro, alkoxy, aryloxy, hetero-oxy, sulfonyloxy, acyloxy, acyl, heterocyclyl such as oxazolidinyl or hydantoinyl, sulfonamido, mercaptotetrazole, benzothiazole, mercaptopropionic acid, phosphonyloxy, arylthio, and alylazo. These coupling-off groups are described in the art, for example, in U.S. Pat. Nos. 2,455,169, 3,227,551, 3,432,521, 3,476,563, 3,617,291, 3,880,661, 4,052,212 and 4,134,766; and in U.K. Patents and published application Nos. 1,466,728, 1,531,927, 1,533,039, 2,006,755A and 2,017,704A, the disclosures of which are incorporated herein by reference.

Image dye-forming couplers may be included in the element such as couplers that form cyan dyes upon reaction with oxidized color developing agents which are described in such representative patents and publications as: U.S. Pat. Nos. 2,367,531, 2,423,730, 2,474,293, 2,772,162, 2,895,826, 3,002,836, 3,034,892, 3,041,236, 4,333,999, 4,883,746 and "Farbkuppler-eine LiteratureUbersicht," published in Agfa Mitteilungen, Band III, pp. 156–175 (1961). Preferably such couplers are phenols and naphthols that form cyan dyes on reaction with oxidized color developing agent.

Couplers that form magenta dyes upon reaction with oxidized color developing agent are described in such representative patents and publications as: U.S. Pat. Nos. 2,311,082, 2,343,703, 2,369,489, 2,600,788, 2,908,573, 3,062,653, 3,152,896, 3,519,429, 3,758,309, 4,540,654, and "Farbkuppler-eine LiteratureUbersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents.

Couplers that form yellow dyes upon reaction with oxidized and color developing agent are described in such representative patents and publications as: U.S. Pat. Nos. 2,298,443, 2,407,210, 2,875,057, 3,048,194, 3,265,506, 3,447,928, 4,022,620, 4,443,536, and "Farbkuppler-eine LiteratureUbersicht," published in Agfa Mitteilungen, Band III, pp. 112–126 (1961). Such couplers are typically open chain ketomethylene compounds.

Couplers that form colorless products upon reaction with oxidized color developing agent are described in such representative patents as: U.K. Patent No. 861,138; U.S. Pat. Nos. 3,632,345, 3,928,041, 3,958,993 and 3,961,959. Typically such couplers are cyclic carbonyl containing compounds that form colorless products on reaction with an oxidized color developing agent.

Couplers that form black dyes upon reaction with oxidized color developing agent are described in such representative patents as U.S. Pat. Nos. 1,939,231; 2,181,944; 2,333,106; and 4,126,461; German OLS No. 2,644,194 and German OLS No. 2,650,764. Typically, such couplers are resorcinols or m-aminophenols that form black or neutral products on reaction with oxidized color developing agent.

In addition to the foregoing, so-called "universal" or "washout" couplers may be employed. These couplers do not contribute to image dye-formation. Thus, for example, a naphthol having an unsubstituted carbamoyl or one substituted with a low molecular weight substituent at the 2- or 3-position may be employed. Couplers of this type are described, for example, in U.S. Pat. Nos. 5,026,628, 5,151,343, and 5,234,800.

It may be useful to use a combination of couplers any of which may contain known ballasts or coupling-off groups such as those described in U.S. Pat. Nos. 4,301,235; 4,853,319 and U.S. Pat. 4,351,897. The coupler may contain solubilizing groups such as described in U.S. Pat. 4,482,629. The coupler may also be used in association with "wrong" colored couplers (e.g. to adjust levels of interlayer correction) and, in color negative applications, with masking couplers such as those described in EP 213.490; Japanese Published Application 58-172,647; U.S. Pat. Nos. 2,983,608; 4,070,191; and 4,273,861; German Applications DE 2,706,117 and DE 2,643,965; U.K. Patent 1,530,272; and Japanese Application 58-113935. The masking couplers may be shifted or blocked, if desired.

Typically, couplers are incorporated in a silver halide emulsion layer in a mole ratio to silver of 0.05 to 1.0 and generally 0.1 to 0.5. Usually the couplers are dispersed in a high-boiling organic solvent in a weight ratio of solvent to coupler of 0.1 to 10.0 and typically 0.1 to 2.0 although dispersions using no permanent coupler solvent are sometimes employed.

The invention materials may be used in association with materials that accelerate or otherwise modify the processing steps e.g. of bleaching or fixing to improve the quality of the image. Bleach accelerator releasing couplers such as those described in EP 193,389; EP 301,477; U.S. Pat. Nos. 4,163,669; 4,865,956; and 4,923,784, may be useful. Also contemplated is use of the compositions in association with nucleating agents, development accelerators or their precursors (UK Patent 2,097,140; U.K. Patent 2,131,188); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The invention materials may also be used in combination with filter dye layers comprising colloidal silver sol or yellow, cyan, and/or magenta filter dyes, either as oil-in-water dispersions, latex dispersions or as solid particle dispersions. Additionally, they may be used with "smearing" couplers (e.g. as described in U.S. Pat. No. 4,366,237; EP 96,570; U.S. Pat. Nos. 4,420,556; and 4,543,323.)

Also, the compositions may be blocked or coated in protected form as described, for example, in Japanese Application 61/258,249 or U.S. Pat. No. 5,019,492.

The invention materials may further be used in combination with image-modifying compounds such as "Developer Inhibitor-Releasing" compounds (DIR's). DIR's useful in conjunction with the compositions of the invention are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346, 899; 362, 870; 365,252; 365,346; 373,382; 376,212; 377,463; 378,236; 384,670; 396,486; 401,612; 401,613.

Such compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference. Generally, the developer inhibitor-releasing (DIR) couplers include a coupler moiety and an inhibitor coupling-off moiety (IN). The inhibitor-releasing couplers may be of the time-delayed type (DIAR couplers) which also include a timing moiety or chemical switch which produces a delayed release of inhibitor. Examples of typical inhibitor moieties are: oxazoles, thiazoles, diazoles, triazoles, oxadiazoles, thiadiazoles, oxathiazoles, thiatriazoles, benzotriazoles, tetrazoles, benzimidazoles, indazoles, isoindazoles, mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzodiazoles, mercaptooxazoles, mercaptothiadiazoles, mercaptothiazoles, mercaptotriazoles, mercaptooxadiazoles, mercaptodiazoles, mercaptooxathiazoles, telleurotetrazoles or benzisodiazoles. In a preferred embodiment, the inhibitor moiety or group is selected from the following formulas:

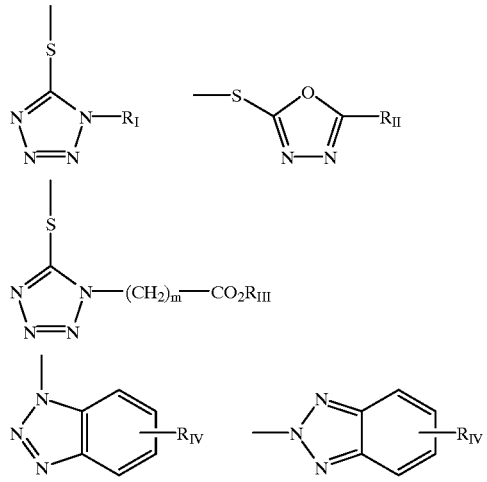

wherein $R_I$ is selected from the group consisting of straight and branched alkyls of from 1 to about 8 carbon atoms, benzyl, phenyl, and alkoxy groups and such groups containing none, one or more than one such substituent; $R_{II}$ is selected from $R_I$ and —$SR_I$; $R_{III}$ is a straight or branched alkyl group of from 1 to about 5 carbon atoms and m is from 1 to 3; and $R_{IV}$ is selected from the group consisting of hydrogen, halogens and alkoxy, phenyl and carbonamido groups, —$COOR_V$ and —$NHCOOR_V$ wherein RV is selected from substituted and unsubstituted alkyl and aryl groups.

Although it is typical that the coupler moiety included in the developer inhibitor-releasing coupler forms an image dye corresponding to the layer in which it is located, it may also form a different color as one associated with a different film layer. It may also be useful that the coupler moiety included in the developer inhibitor-releasing coupler forms colorless products and/or products that wash out of the photographic material during processing (so-called "universal" couplers).

A compound such as a coupler may release a PUG directly upon reaction of the compound during processing, or indirectly through a timing or linking group. A timing group produces the time-delayed release of the PUG such groups using an intramolecular nucleophilic substitution reaction (U.S. Pat. No. 4,248,962); groups utilizing an electron transfer reaction along a conjugated system (U.S. Pat. Nos. 4,409,323; 4,421,845; 4,861,701, Japanese Applications 57-188035; 58-98728; 58-209736; 58-209738); groups that function as a coupler or reducing agent after the coupler reaction (U.S. Pat. Nos. 4,438,193; 4,618,571) and groups that combine the features describe above. It is typical that the timing group is of one of the formulas:

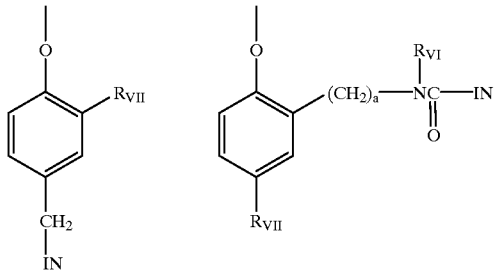

wherein IN is the inhibitor moiety, $R_{VIII}$ is selected from the group consisting of nitro, cyano, alkylsulfonyl; sulfamoyl; and sulfonamido groups; a is 0 or 1; and $R_{VI}$ is selected from the group consisting of substituted and unsubstituted alkyl and phenyl groups. The oxygen atom of each timing group is bonded to the coupling-off position of the respective coupler moiety of the DIAR.

The timing or linking groups may also function by electron transfer down an unconjugated chain. Linking groups are known in the art under various names. Often they have been referred to as groups capable of utilizing a hemiacetal or iminoketal cleavage reaction or as groups capable of utilizing a cleavage reaction due to ester hydrolysis such as U.S. Pat. No. 4,546,073. This electron transfer down an unconjugated chain typically results in a relatively fast decomposition and the production of carbon dioxide, formaldehyde, or other low molecular weight by-products. The groups are exemplified in EP 464,612, EP 523,451, U.S. Pat. No. 4,146,396, Japanese Kokai 60-249148 and 60-249149.

Suitable developer inhibitor-releasing couplers for use in the present invention include, but are not limited to, the following:

D1

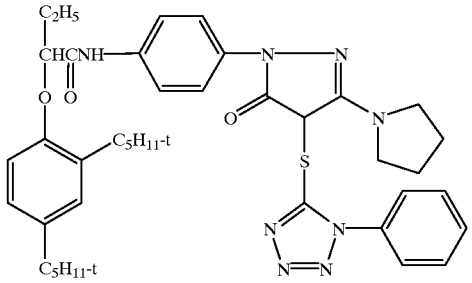

D2

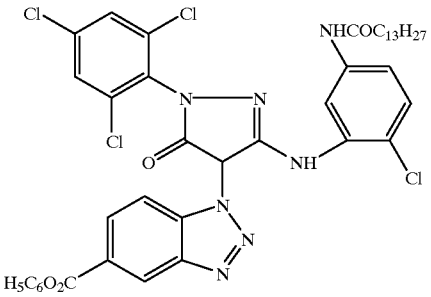

D3

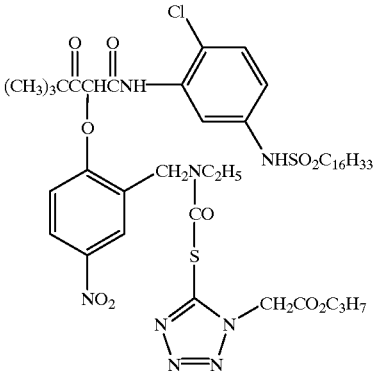

D4

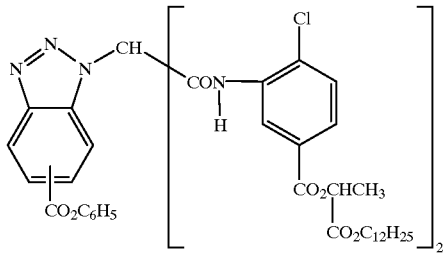

D5

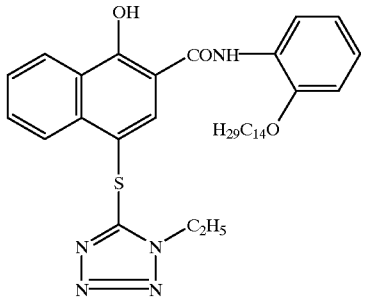

D6
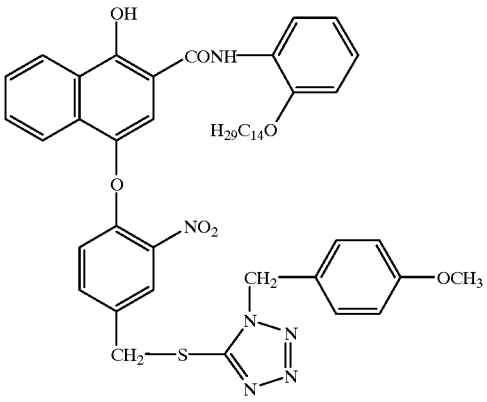
D7
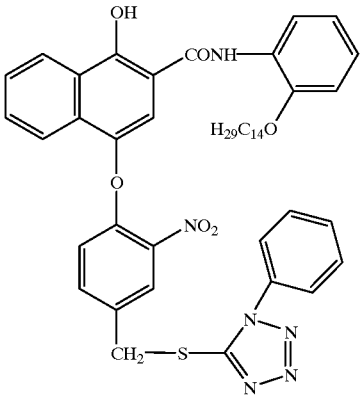
D8
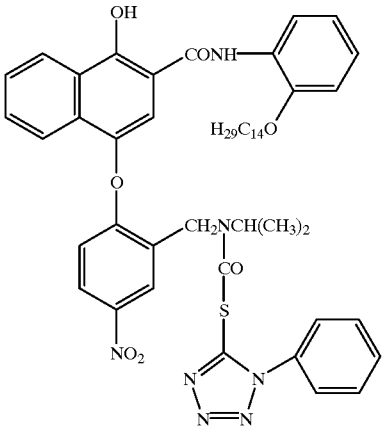
D9
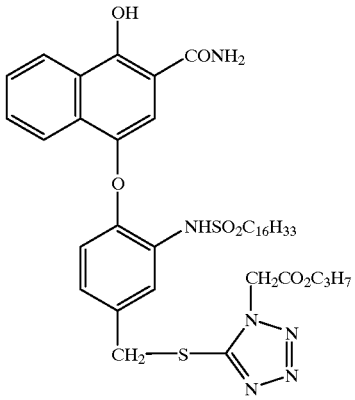
D10
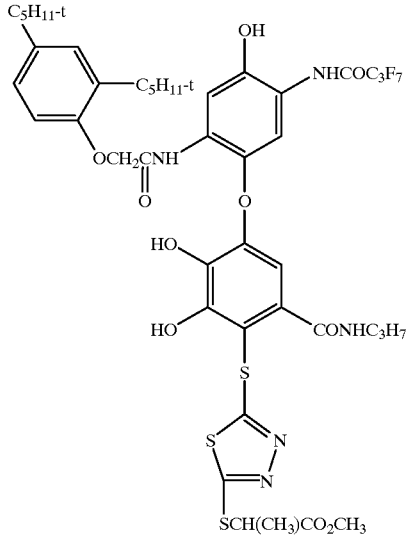
D11
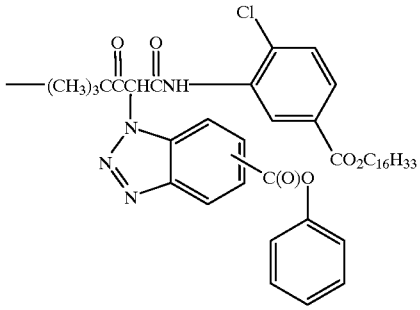

-continued

D12

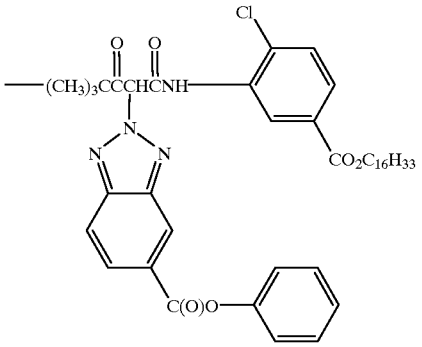

Especially useful in this invention are tabular grain silver halide emulsions. Tabular grains are those having two parallel major crystal faces and having an aspect ratio of at least 2. The term "aspect ratio" is the ratio of the equivalent circular diameter (ECD) of a grain major face divided by its thickness (t). Tabular grain emulsions are those in which the tabular grains account for at least 50 percent (preferably at least 70 percent and optimally at least 90 percent) of the total grain projected area. Preferred tabular grain emulsions are those in which the average thickness of the tabular grains is less than 0.3 micrometer (preferably thin—that is, less than 0.2 micrometer and most preferably ultrathin—that is, less than 0.07 micrometer). The major faces of the tabular grains can lie in either {111} or {100} crystal planes. The mean ECD of tabular grain emulsions rarely exceeds 10 micrometers and more typically is less than 5 micrometers.

In their most widely used form tabular grain emulsions are high bromide {111} tabular grain emulsions. Such emulsions are illustrated by Kofron et al U.S. Pat. No. 4,439,520, Wilgus et al U.S. Pat. No. 4,434,226, Solberg et al U.S. Pat. No. 4,433,048, Maskasky U.S. Pat. Nos. 4,435,501, 4,463,087 and 4,173,320, Daubendiek et al U.S. Pat. Nos. 4,414,310 and 4,914,014, Sowinski et al U.S. Pat. No. 4,656,122, Piggin et al U.S. Pat. Nos. 5,061,616 and 5,061,609, Tsaur et al U.S. Pat. Nos. 5,147,771, '772, '773, 5,171,659 and 5,252,453, Black et al U.S. Pat. Nos. 5,219,720 and 5,334,495, Delton U.S. Pat. Nos. 5,310,644, 5,372,927 and 5,460,934, Wen U.S. Pat. No. 5,470,698, Fenton et al U.S. Pat. No. 5,476,760, Eshelman et al U.S. Pat. Nos. 5,612,175 and 5,614,359, and Irving et al U.S. Pat. No. 5,667,954.

Ultrathin high bromide {111} tabular grain emulsions are illustrated by Daubendiek et al U.S. Pat. Nos. 4,672,027, 4,693,964, 5,494,789, 5,503,971 and 5,576,168, Antoniadcs et al U.S. Pat. No. 5,250,403, Olm et al U.S. Pat. No. 5,503,970, Deaton et al U.S. Pat. No. 5,582,965, and Maskasky U.S. Pat. No. 5,667,955.

High bromide {100} tabular grain emulsions are illustrated by Mignot U.S. Pat. Nos. 4,386,156 and 5,386,156.

High chloride {111} tabular grain emulsions are illustrated by Wey U.S. Pat. No. 4,399,215, Wey et al U.S. Pat. No. 4,414,306, Maskasky U.S. Pat. Nos. 4,400,463, 4,713,323, 5,061,617, 5,178,997, 5,183,732, 5,185,239, 5,399,478 and 5,411,852, and Maskasky et al U.S. Pat. Nos. 5,176,992 and 5,178,998. Ultrathin high chloride {111} tabular grain emulsions are illustrated by Maskasky U.S. Pat. Nos. 5,271,858 and 5,389,509.

High chloride {100} tabular grain emulsions are illustrated by Maskasky U.S. Pat. Nos. 5,264,337, 5,292,632, 5,275,930 and 5,399,477, House et al U.S. Pat. No. 5,320,938, Brust et al U.S. Pat. No. 5,314,798, Szajewski et al U.S. Pat. No. 5,356,764, Chang et al U.S. Pat. Nos. 5,413,904 and 5,663,041, Oyamada U.S. Pat. No. 5,593,821, Yamashita et al U.S. Pat. Nos. 5,641,620 and 5,652,088, Saitou et al U.S. Pat. No. 5,652,089, and Oyamada et al U.S. Pat. No. 5,665,530. Ultrathin high chloride {100} tabular grain emulsions can be prepared by nucleation in the presence of iodide, following the teaching of House et al and Chang et al, cited above.

The emulsions can be surface-sensitive emulsions, i.e., emulsions that form latent images primarily on the surfaces of the silver halide grains, or the emulsions can form internal latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent. Tabular grain emulsions of the latter type are illustrated by Evans et al. U.S. Pat. No. 4,504,570.

Photographic elements can be exposed to actinic radiation, typically in the visible region of the spectrum, to form a latent image and can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

With negative-working silver halide, the processing step described above provides a negative image. One type of such element, referred to as a color negative film, is designed for image capture. Speed (the sensitivity of the element to low light conditions) is usually critical to obtaining sufficient image in such elements. Such elements are typically silver bromojodide emulsions coated on a transparent support and are sold packaged with instructions to process in known color negative processes such as the Kodak C-41 process as described in The British Journal of Photography Annual of 1988, pages 191–198. If a color negative film element is to be subsequently employed to generate a viewable projection print as for a motion picture, a process such as the Kodak ECN-2 process described in the H-24 Manual available from Eastman Kodak Co. may be employed to provide the color negative image on a transparent support. Color negative development times are typically 3'15" or less and desirably 90 or even 60 seconds or less.

The photographic element of the invention can be incorporated into exposure structures intended for repeated use or exposure structures intended for limited use, variously referred to by names such as "single use cameras", "lens with film", or "photosensitive material package units".

Preferred color developing agents are p-phenylenediamines such as:

4-amino-N,N-diethylaniiline hydrochloride, 4-amino-3-methyl-N,N-diethylaniline hydrochloride, 4-amino-3-methyl-N-ethyl-N-(2-methanesulfonamidoethyl)aniline sesquisulfate hydrate, 4-amino-3-methyl-N-ethyl-N-(2-hydroxyethyl)aniline sulfate, 4-amino-3-(2-methancsulfonamidoethyl)-N,N-diethylaniline hydrochloride and 4-amino-N-ethyl-N-(2-methoxyethyl)-m-toluidine di-p-toluene sulfonic acid.

Development is usually followed by the conventional steps of bleaching, fixing, or bleach-fixing, to remove silver or silver halide, washing, and drying.

SYNTHESIS EXAMPLE

Synthesis of quinone Q-1

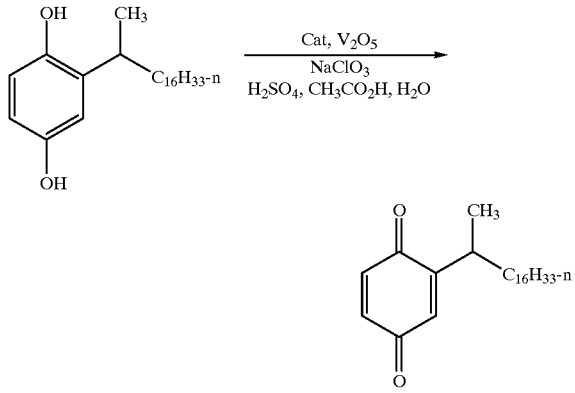

Q-1

A 12-L flask was equipped with stirrer and thermometer and 2-(2-octadccyl)hydroquinone (700 g, 1.93 mol) was added, followed by 8000 mL glacial acetic acid, 2000 mL water, vanadium pentoxide (5.62 g, 0.03 mol), and 85 mL concentrated sulfuric acid. The mixture was warmed to 60° C. with a steam bath until the solids had completely dissolved. The steam bath was then removed, and sodium chlorate (205 g, 1.93 mol) was added slowly, resulting in an exotherm to 75° C. After stirring overnight without additional heating, a yellow solid separated, which was collected, washed with water, and pressed in a small Lapp funnel. The damp product was recrystallized twice from ethanol to yield 514 g (74%) of Q-1 as a yellow solid. Mass spectrum (m/e): 360 $(M-H)^+$.

PHOTOGRAPHIC EXAMPLES

Example 1

Monolayer Photographic Evaluation

Photographic element 101 was prepared by coating the following layers in the order listed onto a cellulose acetate support with conventional subbing layers:

Layer 1:

4.89 g/m$^2$ gelatin

Layer 2:

2.15 g/m$^2$ gelatin;

0.75 g/m$^2$ silver (as silver bromoiodide)

0.43 g/m$^2$ MC-1

0.108 g/m$^2$ azopyrazolone masking coupler MY-1 and 0.025 g/m$^2$ Q-1 co dispersed in their combined weight of tri tolyl phosphate;

0.012 g/m$^2$ (1,2,4)triazolo(1,5-a)pyrimidin-7-ol, 5-methyl-, sodium salt

Layer 3:

Bis-(vinylsulfonylmethyl) ether at 1.75% total gelatin;

2.69 g/m$^2$ gelatin

Photographic elements 102–110 were prepared by replacing quinone Q-1 with an equimolar amount of one of the quinones shown in Table I. Photographic element 111 was prepared by omitting a quinone entirely.

Prior to coating each film, the emulsion-coupler mixture of layer 2 was divided into two equal portions; one was held at 0° C. for 16 hours, and the other was heated at 45° C. for 16 hours. The photographic data for the resulting processed coatings are given in the Table I, where C indicates a comparison quinone and I indicates a quinone of this invention. $D_{min}$ is the image density in the absence of exposure and is a measure of undesired fog, or density produced without the action of image-forming exposure. The change in $D_{min}$ ($\Delta D_{min}$ in Table I) is the $D_{min}$ of the coating prepared from the coupler-emulsion mixture heated at 45° C. for 16 hrs minus the $D_{min}$ of the coating prepared from the coupler-emulsion mixture held at 0° C. for the same period. Gamma is used to measure the contrast of a photographic material which is the ratio of an incremental change in image density to the corresponding incremental change in log exposure and is the maximum incremental change measured over an exposure range extending between a point lying at a density of 0.15 above minimum density and a second point separated from the first reference point by 0.9 log E. The change in gamma (Δgamma in Table I) is the maximum gamma of the coating prepared from the coupler-emulsion mixture heated at 45° C. for 16 hrs minus the maximum gamma of the coating prepared from the coupler-emulsion mixture held at 0° C. for the same period.

Speed, which measures the sensitivity of the photographic material, is inversely proportional to the logarithm of the exposure at the point where the density is 0.15 units above $D_{min}$. The exposure scale is normalized such that each unit change in speed represents a 0.01 unit change in the logarithm of the exposure. The change in speed (Δspeed in Table I) is the speed of the coating prepared from the coupler-emulsion mixture heated at 45° C. for 16 hrs minus the speed of the coating prepared from the coupler-emulsion mixture held at 0° C. for the period.

It can be seen from the results in the Table I that addition of illustrative compounds of the present invention serve to markedly lower fog and improve speed and contrast compared to having no quinone or compared to quinones CQ-1 through CQ-7, which are hardly effective.

TABLE I
| Element | Quinone/ID/Type | | | Changes in film parameters after 16 hr, 45° C. | | |
|---|---|---|---|---|---|---|
| | | | | $\Delta D_{min}$ | Δspeed | gamma |
| 101 | 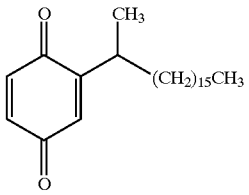 | Q-1 | I | −0.030 | 2 | −0.161 |
| 102 | 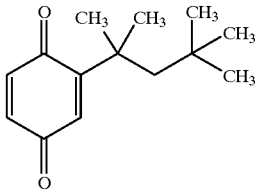 | Q-2 | I | 0.048 | −2 | −0.091 |
| 103 | 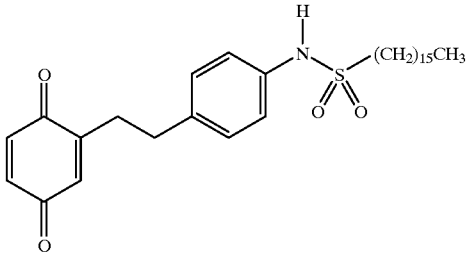 | Q-3 | I | 0.01 | −6 | 0.067 |
| Inv. Avg- | | | | −0.008 | −2 | −0.061 |
| 104 | 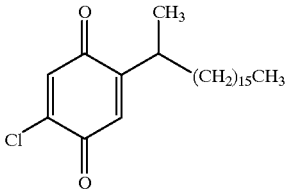 | CQ-1 | C | 0.224 | −33 | −0.769 |
| 105 | 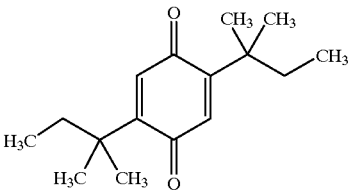 | CQ-2 | C | 0.177 | −21 | −0.975 |
| 106 | 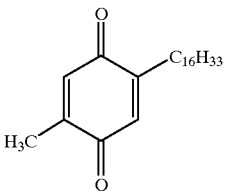 | CQ-3 | C | 0.130 | −23 | −0.617 |

TABLE I-continued

| Element | Quinone/ID/Type | | | Changes in film parameters after 16 hr, 45° C. $\Delta D_{min}$ | Δspeed | gamma |
|---|---|---|---|---|---|---|
| 107 | 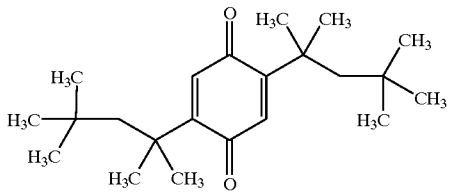 | CQ-4 | C | 0.152 | −19 | −0.745 |
| 108 | 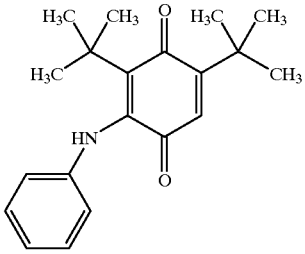 | CQ-5 | C | 0.193 | −33 | −0.674 |
| 109 | 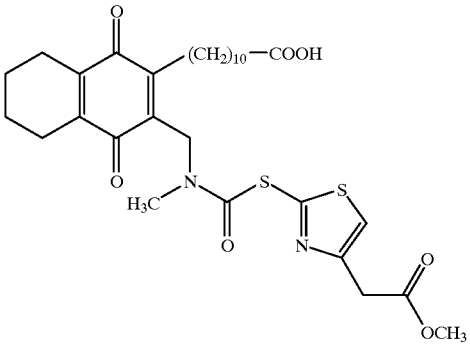 | CQ-6 | C | 0.161 | −14 | −0.746 |
| 110 | 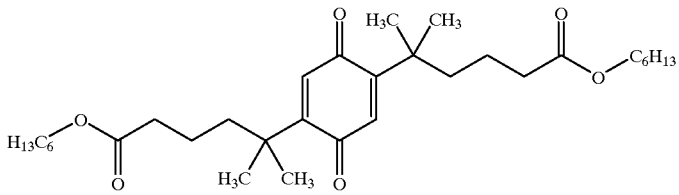 | CQ-7 | C | 0.112 | −14 | −0.459 |
| C Avg | | | | 0.164 | −22 | −0.712 |
| 111 | None | | C | 0.20 | −40 | −0.50 |

The data from the table show that the monosubstituted quinones Q-1 through Q-3 provide a significantly improved photographic element compared to the comparison quinones or to no quinone at all. The average effect on undesirable fog due to melt holding at elevated temperature is slight (actually—improved by 0.008) with the monosubstituted quinones but undesirably increases by 0.164 for the comparisons. Similarly, the speed using the inventive quinone drops by only two units while the average of the comparisons drops 22 units. Further, the gamma drops by 0.06 units for the inventive quinone but by 0.71 units for the comparisons. Sample 111 using no quinone at all produced results similar to the comparatives.

The entire contents of the patents and other publications cited in this specification are incorporated herein by reference.

What is claimed is:

1. A photographic element comprising a light-sensitive silver halide emulsion layer containing an azopyrazolone masking coupler and a monosubstituted quinone of formula I:

I

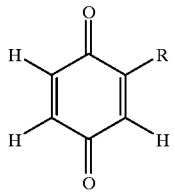

wherein R is selected from the group consisting of alkyl, aryl, alkoxy, aryloxy, alkylthio, arylthio, sulfinyl, sulfonyl, sulfamoyl, halogen, cyano, thiol, hydroxy, nitro, acyloxy, sulfonyloxy, heterocyclic, carboxylic acid, carboxylate, carbamoyl, amino, carbonamido and sulfonamido groups.

2. A photographic element as in claim 1 where R is selected from the group consisting of alkyl, aryl, alkoxy, aryloxy, alkylthio, arylthio, sulfinyl, sulfonyl, sulfamoyl, acyloxy, sulfonyloxy, heterocyclic, carboxylate, carbamoyl, amino, carbonamido and sulfonamido groups.

3. A photographic clement as in claim 2 where R contains at least 8 carbon atoms.

4. A photographic element as in claim 2 where R is selected from the group consisting of alkyl, aryl, amino, alkoxy and aryloxy groups.

5. A photographic element as in claim 4 where R contains at least 8 carbon atoms.

6. A photographic element as in claim 4 where R is selected from the group consisting of alkyl, aryl and amino groups.

7. A photographic element as in claim 6 where R contains at least 8 carbon atoms.

8. A photographic element as in claim 6 where R is a group selected from a cycloalkyl group and a straight chain or branched chain alkyl group.

9. A photographic element as in claim 8 where R contains at least 8 carbon atoms.

10. A photographic element as in claim 6 where R is an amino group.

11. A photographic element as in claim 10 where R contains as least 8 carbon atoms.

12. A photographic element of claim 3 where the molar ratio of the quinone of Formula I to masking coupler is in the range of 1:5 to 5:1.

13. A photographic element of claim 5 where the molar ratio of the quinone of Formula I to masking coupler is in the range of 1:5 to 5:1.

14. A photographic element of claim 7 where the molar ratio of the quinone of Formula I to masking coupler is in the range of 1:5 to 5:1.

15. A photographic element of claim 14 which also contains in the layer a 4-acylamino substituted pyrazolone magenta image dye-forming coupler.

16. A photographic element of claim 14 which also contains in the layer a 4-anilino substituted pyrazolone magenta image dye-forming coupler.

17. A photographic element of claim 14 which also contains in the layer a magenta dye forming bicyclic azole image dye-forming coupler.

18. A photographic element of claim 1 where the quinone is selected from the group consisting of:

Q-1

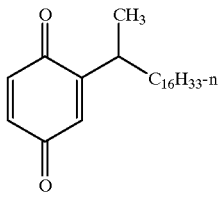

Q-2

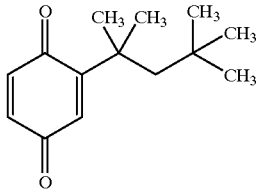

Q-3

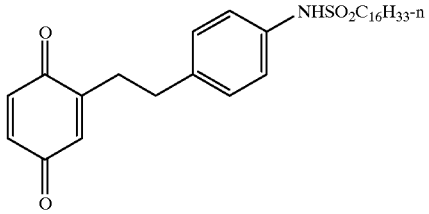

Q-4

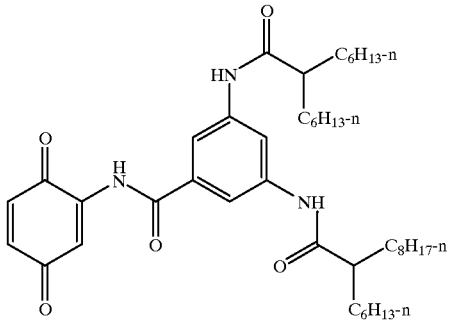

Q-5

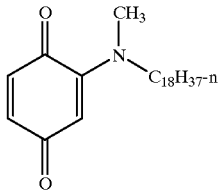

Q-6

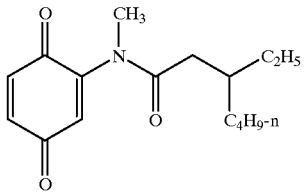

Q-7

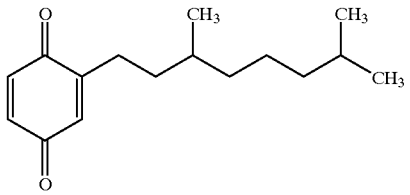

-continued
Q-8
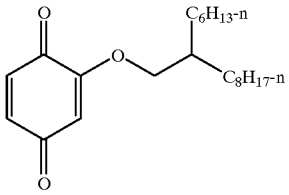
Q-9
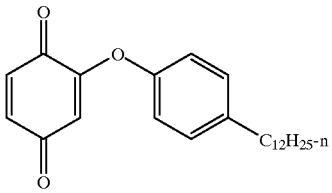
Q-10
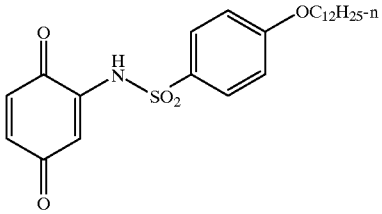
Q-11
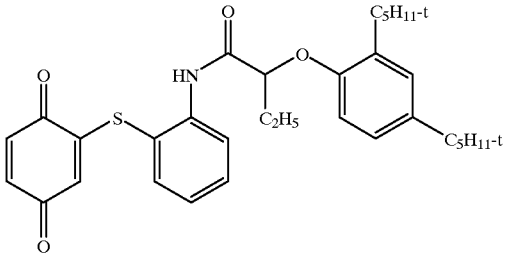
Q-12
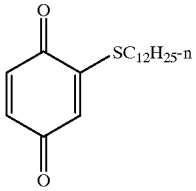
Q-13
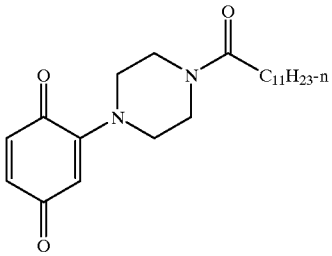
Q-14
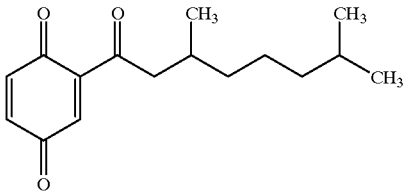
-continued
Q-15
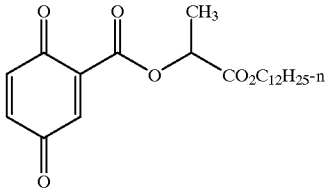
Q-16
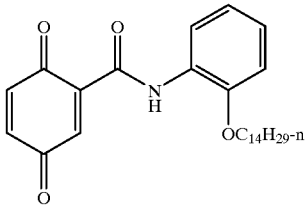
Q-17
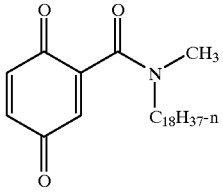
Q-18
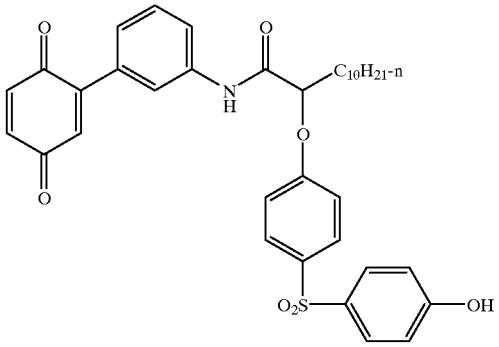
Q-19
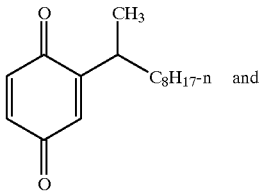
and
Q-20
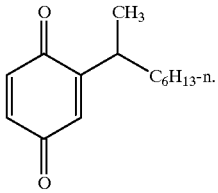
19. A photographic element of claim 18 where the quinone is selected from the group consisting of:

Q-1
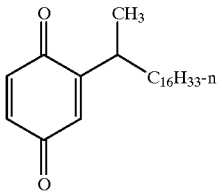
Q-2
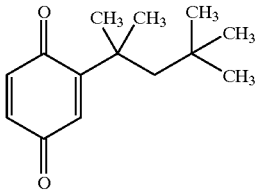
and
-continued
Q-3
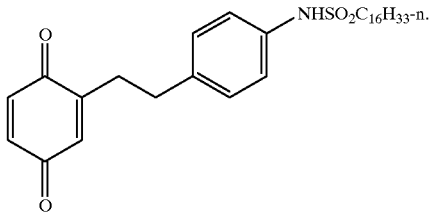
20. A method of forming an image in the photographic element of claim 1 after the element has been imagewise exposed to light, comprising contacting the element with a color developing agent.
* * * * *